United States Patent [19]

Giron et al.

[11] Patent Number: 4,629,408

[45] Date of Patent: Dec. 16, 1986

[54] PORTABLE CONCRETE BEAM HARPING SYSTEM

[75] Inventors: Anthony S. Giron, Diamond Bar; Andrew T. Curd, Valencia, both of Calif.

[73] Assignee: Arctic Equipment Rental, Inc., Diamond Bar, Calif.

[21] Appl. No.: 773,425

[22] Filed: Sep. 6, 1985

[51] Int. Cl.[4] ..... B28B 23/06

[52] U.S. Cl. ..... 425/111; 29/452; 52/225; 52/227; 249/50; 264/228; 264/229

[58] Field of Search ..... 425/88, 111; 264/228, 264/229; 249/50, 83; 52/225, 226, 227; 29/452; 100/234, 235

[56] References Cited

U.S. PATENT DOCUMENTS

| | | | |
|---|---|---|---|
| 455,687 | 7/1891 | McCarthy | 52/225 |
| 2,958,507 | 11/1960 | Hartup | 52/225 |
| 3,003,217 | 10/1961 | Gerwick, Jr. | 249/50 |
| 3,050,283 | 8/1962 | Tumey | 425/111 |
| 3,084,909 | 4/1963 | Carr | 52/225 |
| 4,149,306 | 4/1979 | Tice | 425/111 |
| 4,492,552 | 1/1985 | Murakami et al. | 264/228 |

FOREIGN PATENT DOCUMENTS

| | | | |
|---|---|---|---|
| 1493316 | 11/1977 | United Kingdom | 425/111 |

OTHER PUBLICATIONS

"Frictionless Deflectors Simplify Pretensioning", *Construction Methods and Equipment,* May 1958.

*Primary Examiner*—Jay H. Woo
*Assistant Examiner*—James C. Housel
*Attorney, Agent, or Firm*—Poms, Smith, Lande & Rose

[57] ABSTRACT

A portable system for making harped, reinforced concrete beams includes a series of inverted T-shaped concrete bed sections, with aligned longitudinally extending holes for receiving tensioning cables to hold the sections together, to provide two beds, one on either side of the center wall of the sections, to make the concrete beams. At points near the center of each beam to be formed, arrangements for "harping" or depressing the longitudinally extending tensioning steel strands or cables are provided. The harping arrangements include a lever pivotally mounted on the central wall of the concrete sections to pivot in either direction to alternatively harp beams on either side, with intermediate lever actuated arrangements including a harping fork for engaging the steel strands, and screw threaded arrangements at the outer end of the lever for pulling the lever down toward the outer edge of the concrete bed, thereby depressing and harping the tensioning steel strands which are to be embedded in the concrete beams.

21 Claims, 14 Drawing Figures

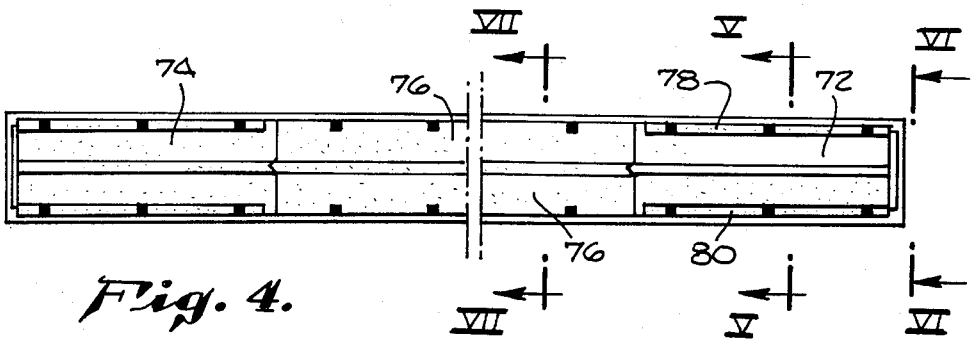
Fig. 4.
Fig. 5.
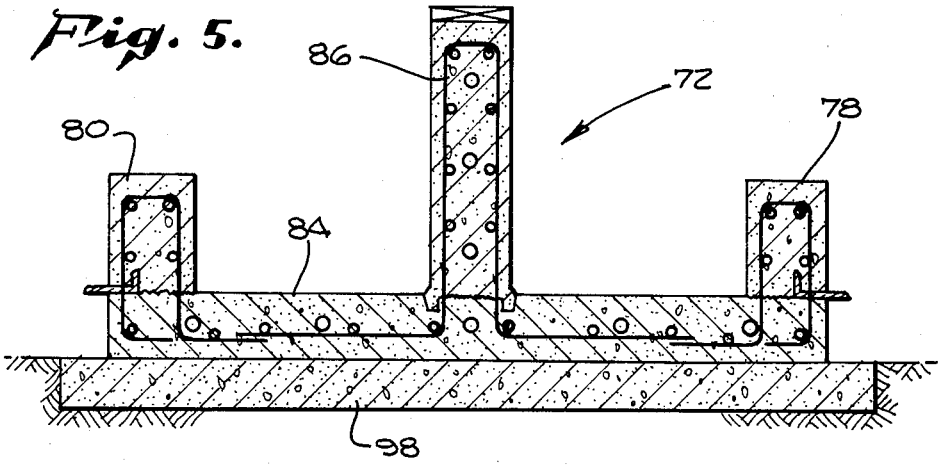
Fig. 6.
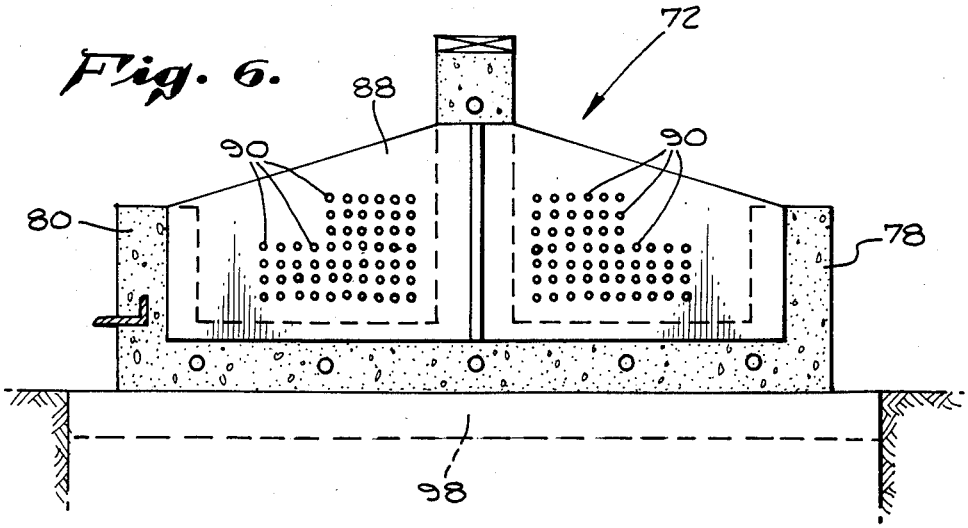

PORTABLE CONCRETE BEAM HARPING SYSTEM

FIELD OF THE INVENTION

This invention relates to apparatus for making harped, reinforced concrete beams.

BACKGROUND OF THE INVENTION

It is well known in the field of reinforced concrete beams that the use of longitudinally extending steel strands in the lower portion of the beam will increase the strength of the beam; and that the strength will be furher increased by depressing or "harping" the steel strands toward the middle of the beam. This is described in many texts on concrete, including, for example, Modern Prestressed Concrete, by James R. Libby, Van Nostrand Reinhold Co., N.Y., N.Y., 1984. The harping of the steel strands in the reinforced concrete is very advantageous, as it increases the strength of the beams significantly. Thus, for example, a 60-foot beam having a cross section of thirty-one (31) inches by sixteen (16) inches, and using sixteen (16) conventional linear steel strands could be replaced by a beam having a width of only twelve (12) inches, and having only fourteen (14) steel strands, if the steel strands are appropriately harped, or depressed toward the bottom of the beam, at the center of the beam.

However, relatively high forces are involved in tensioning the steel strands which are used in such concrete beams, and the deflecting of the steel strands is not easily accomplished at the job site. The inventors are familiar with one effort to make harped beams on the job site using plastic tubes to hold the steel tensioning cables or strands at the proper elevations at the middle and at the beam ends in several aligned beam forms, and then attempting to tension the strands. This effort was unsuccessful, and no other efforts to make harped beams at the job site are known to the inventors.

Harped concrete beams have normally been made at fixed casting yards. At these fixed plant locations, heavy, permanent, steel bed are normally employed, and these beds are formed of welded steel plates with the beds being several hundred feet long so that a number of beams may be constructed in line using a single set of tensioned steel strands. Following tensioning, the strands are harped, or pulled down by small fixtures which engage one or two sets of vertically aligned strands. In some cases, rollers which are employed in harping several horizontally and vertically spaced cable strands are left in the beam, thereby increasing the cost of the beam. In view of the permanent nature of the installation, permanent utility installations are employed, and powerful permanent installations are used. In many cases the harping method involves arrangements located in permanent pits below the steel beds. In one recent case involving necessary relocation of such a fixed casting yard, the need to cut apart the huge permanent one-piece steel bed, and the necessary re-welding and grinding, means that the local relocation costs will exceed one million dollars.

It is also noted that, when harped concrete beams are purchased from a fixed casting yard, the high cost and difficulties of moving large numbers of big heavy beams which may be sixty feet or more in length, are encountered. These may be so substantial that construction companies often prefer to cast their own un-harped beams locally, using a portable bed, at the construction site. One such portable bed is shown in U.S. Pat. No. 4,149,306.

Accordingly, a principal object of the present invention is to provide a simple, portable system for producing long span, harped, precast concrete beams, which may be accomplished at the construction site.

SUMMARY OF THE INVENTION

In accordance with the present invention, a portable system for making pre-cast harped reinforced concrete beams includes a set of inverted T-shaped sections of concrete, with most of said sections of concrete being more than 20 feet long, and with the sections having aligned spaced holes extending from end to end of each section, so that they may be locked together and aligned by means of tensioned cables extending through all of the concrete sections. When the concrete sections are secured together and aligned, they form two beds, one on either side of the central concrete wall of the inverted T-shaped concrete sections. Steel strands extending from end to end of the entire section are initially laid in place and tensioned. Local harping arrangements include a lever pivoted on the central wall, and extending in either direction, alternately, to provide harping action either for being on one side of the center wall or on the other. A cable engaging member is secured to the lever, and extends downwardly to engage the strands of the tensioning cable. The outer end of the lever is moved downward by powerful arrangements, so that the cable strands are deflected downward by the desired harping distance. The outer end of the lever is then locked down into place until the concrete beam is poured and has the opportunity to set up.

The sections of concrete bed may be several hundred feet long, so that a large number of beams may be cast, substantially at one time. Between each of the beams is a set of rollers to maintain the tensioning strands or cables at the proper elevation at the ends of the beams. At the desired center of each of the beams, a pivoted lever of the type mentioned above is mounted, and after the harping has been accomplished at one beam, the powerful arrangements for lowering the outer end of the lever are shifted to the center of the next beam, to the next successive harping lever mechanism.

Incidentally, as one aspect of the invention, the arrangements for engaging the tensioning cables during harping may be in the form of a fork for engaging several horizontally spaced columns of cables, with the strands in each column overlying and engaging one another as the fork is depressed. The fork is left within the prestressed concrete beam; however, the pin or shaft by which the fork is depressed by the lever may be removed after the concrete beam has set up, and the pre-tensioned cables are held in place by the hardening concrete.

The arrangements for mounting and actuating the harping levers is of particular interest. The levers are pivotally mounted on pivot arrangements set into the upwardly extending center wall of the inverted T-shaped concrete beds. Good mechanical advantage is obtained, with the harping fork depressor pin or shaft being mounted close to the pivot point, perhaps one foot from the pivot point, with the outer end of the lever being about three and one-half feet from the pivot point. A depressor arm for pulling down the outer end of the lever arm is mounted with the lower end of the depressor arm pivotally secured to the outer edge of the bed. A long, high strength threaded bolt is employed to interconnect the depressor arm and the outer end of the harping lever, with the bolt head being mounted on a bearing member on an enlarged, open, upper end of the depressor arm. A large mating nut is pivotally and removably mounted on the outer end of the lever arm. The harping fork must be depressed about nine inches to harp the cable strands, and with a three or four to one lever arm ratio to the outer end of the lever, the bolt must be tightened up thirty inches or more. Accordingly, the lever arm is initially at a substantial elevated angle relative to the horizontal. To provide the powerful force needed to tighten up the bolt, a pneumatic bolt actuating driver, similar to that used by tire shops for removing wheel lugs, is employed. This fits within the open, upper end of the depressor arm, and engages and rotates the bolt head, on the large bolt intercoupling the depressor arm and the harping lever. The depressor arm and the bolt and nut are readily removable to be used at the next harping point, after the anchor strap is secured in position. Incidentally, the anchor strap is preferably inbound of the depressor arm, as it is a permanent part of the local harping assembly, and it is desirable to attach the depressor arm at the outer end of the lever arm to provide maximum mechanical advantage.

At the ends of the portable beds formed of the inverted T-shaped concrete sections, are thick apertured steel plates, to withstand the tensioning forces and to properly orient the ends of the steel strands or cables. In addition, the end sections of concrete may be provided with additional outer walls, in order to adequately support the heavy steel apertured plates at the ends of the entire asssemblange of bed sections, and to transfer the longitudinal forces to the inverted T-shaped composite bed.

The present system has the advantage of providing localized manufacture of harped prestressed concrete beams, locally, on site, so that they need not be trucked in from a central fixed casting yard. Thus, the new system provides the advantages of using harped beams including the reduced weight of individual beams and the reduced overall weight of the structure being built, without the disadvantages mentioned above. In addition, when it is desired to shift to a new construction site, the tensioning cables which hold the inverted T-shaped bed sections of concrete may be uncoupled, and the sections transported to a new location where they are reassembled and again put into production.

Other objects, features, and advantages of the invention will become apparent from a consideration of the following detailed description and from the accompanying drawings.

BRIEF DESCRIPTION OF THE DRAWINGS

FIG. 4 is a top plan view of a multi-section portable concrete bed illustrating the principles of the present invention;

FIGS. 5, 6 and 7 are views taken along lines V—V, VI—VI and VII—VII of FIG. 4;

DETAILED DESCRIPTION

Figure 1:
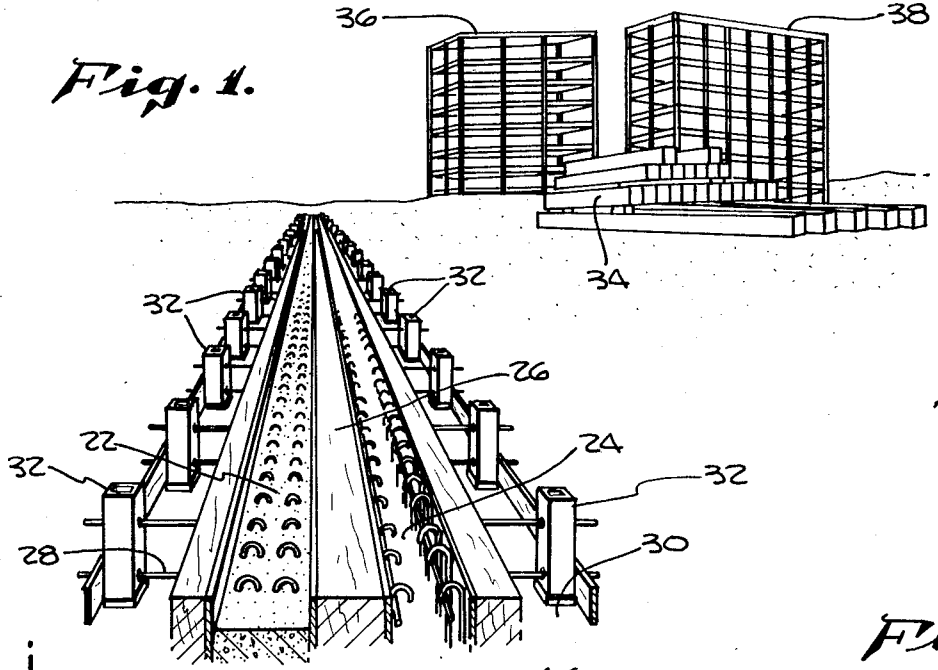
FIG. 1 is a perspective view of a portable bed for constructing harped reinforced concrete beams illustrating the principles of the present invention.

Referring more particularly to the drawings, FIG. 1 is an over-all view of a construction site showing an installation illustrating the principles of the invention in which a first set of harped concrete beams 22 has been poured, and a second set of beams will shortly be poured into the forms 24 within which the mild steel reinforcing bar "cages" have already been placed. The bed on which the reinforced concrete beams are formed, includes a series of concrete bed sections, each having a cross section in the form of an inverted "T". In FIG. 1, the central wall 26 is visible, as are the two outer edges, 28 and 30, into which the form supporting posts 32 are secured. A series of beams which have been previously poured and formed are shown at 34 in FIG. 1, and the buildings 36 and 38 which are being constructed appear in the backbround.

Figure 2:
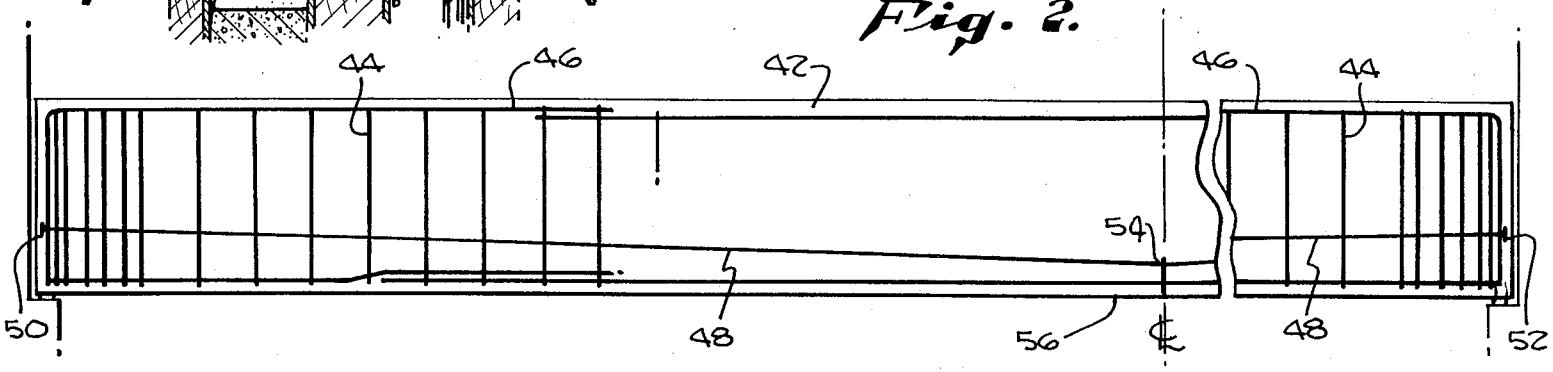
FIG. 2 is a side cross-sectional view of a typical concrete beam formed in accordance with the principles of the present invention.

Now, referring to FIG. 2, it shows a side view of a reinforced concrete beam 42. The beam 42 includes the usual mild steel reinforcing bar 44 and 46 extending perpendicular to and parallel to the longitudinal axis of the beam. One tensioning strand 48 is shown extending from one end 50 of the beam to the other end 52 thereof. It may be noted that the center of the tensioning strand designated by the reference numeral 54 is depressed somewhat so that it is closer to the lower edge of the beam 56 than it is at the two ends of the beam. This is known as "harping". Now, in considering the beam 42 of FIG. 2, let us assume that it is supported at its two ends and that it is loaded uniformly. Under these circumstances, the lower portion of the beam is normally in tension, and the upper portion of the beam is in compression. As is well known, concrete is very strong in compression, but quite weak in tension. For this reason, under conventional precast concrete beam practice, the additional tensioning steel strands or cables such as the cable 48 shown in FIG. 2, are employed in the lower section of the beam, but not in the upper section thereof. Now, for reasons which are developed in detail as a result of force studies, it has been determined that depressing or "sharping" the steel strands or cables such as the cable 48 shown in FIG. 2, will have the effect of greatly increasing the strength of the beam.

Figure 3:
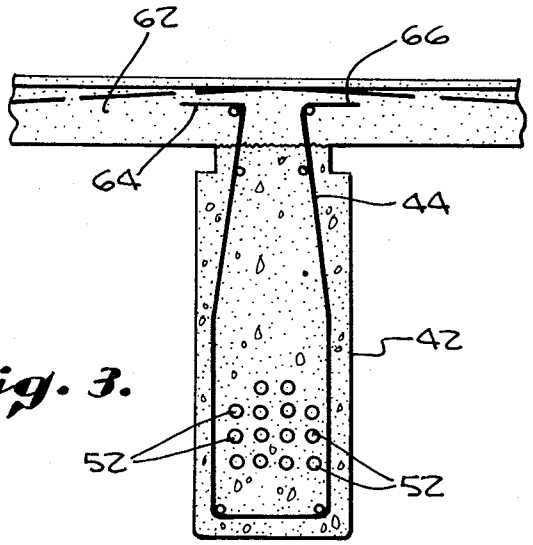
FIG. 3 is a transverse cross-sectional view showing how a harped beam such as that shown in FIG. 2 of the drawings may be employed in building construction.

As shown in FIG. 3 of the drawings, a beam such as the beam 42 may be secured in position by the steel reinforcing rods or bars 44 which may interlock with an overlying beam such as the beam 62, as shown in FIG. 3. In this regard, it may be noted that the reinforcing rod 44 has upper ends 64 and 66 which extend into and interlock with another beam or the overlying cement construction 62. In FIG. 3 the number of steel tensioning cables or strands are indicated by the reference numeral 53, while only one reference numeral 48 was applied to one typical strand, in FIG. 2 of the drawings. The nature of the displacement of the steel strands in the course of the harping process will be discussed in greater detail in connection with one of the subsequent figures of the drawings.

Figure 7:
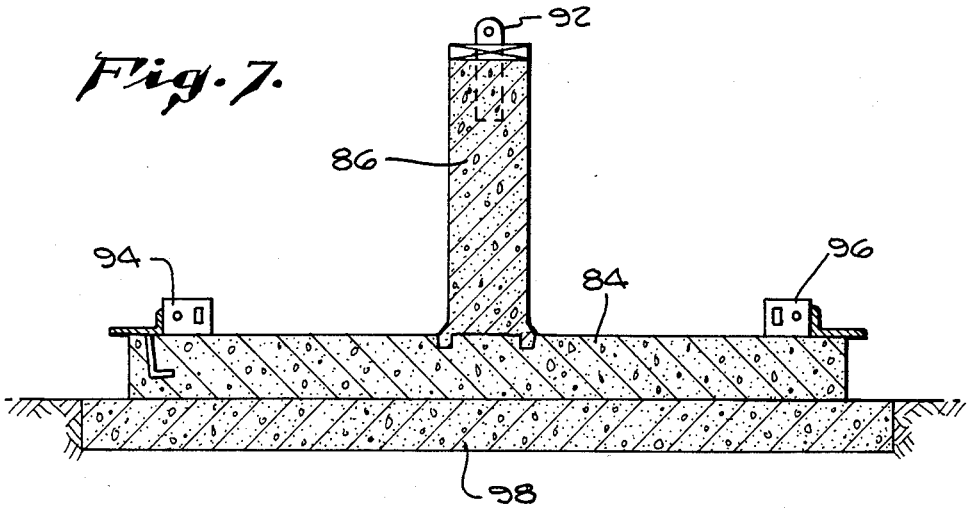

FIG. 4 is a top assembly view of the series of concrete sections shown in FIG. 1; FIG. 5 is a cross-sectional view taken along lines V—V of FIG. 4; FIG. 6 is an end view taken at VI—VI of FIG. 4; and FIG. 7 is a cross-sectional view taken at one of the harping points such as at VII—VII of FIG. 4. With reference to FIG. 4, it includes two end sections 72 and 74, and a series of intermediate sections 76. By way of example and not of limitation, the two end sections may be relatively short, for example, 21 feet in length, and the intermediate sections may be 50 or 60 feet in length. In addition, each of the two end sections have sidewalls, and these are designated by the reference numerals 78 and 80 in FIGS. 4 and 5. All of the sections of the concrete bed 72, 74, 76 are provided with a series of holes 82 extending both through the base plate section 84 of the entire bed, and also through the upstanding wall portion 86 extending for the entire length of the bed. These holes remain open, and may be formed by using accurately aligned inexpensive plastic pipe accurately located within the cement bed. The holes are later threaded by tensioning cables which extend for the entire length of the bed. These tensioning cables are tightened up, in the same manner as the cables employed for reinforcing the concrete, and hold the bed tightly together, so that the beams are properly aligned and formed true and straight. Prior to assembling the bed made up of the inverted T-shaped sections of concrete as discussed above, a concrete "sidewalk" or bed of that general type may be poured, to give a simple and adequate support for the bed.

The two sidewalls 78 and 80, as seen in FIGS. 4 and 5, provide increased support and strengthening for the heavy apertured steel plate 88 which is shown in FIG. 6 of the drawings. This plate 88 may be in the order of 5 or 6 inches thick, in view of the tremendous forces applied to it. The apertures 90 in the steel plate 88 provide the proper positioning for selected steel strands or cables which are intended to extend for the length of the bed, going through the forms for what will be several reinforced and tensioned beams. Not all of the holes will be used for any one beam, but a large number of holes 90 are provided so that the desired pattern of steel cables or strands is always available for use with the variable width and variable height beams which may be poured.

FIG. 7 is a cross-sectional view taken along lines VII—VII of FIG. 4, and indicates a harping point. Mounted on the central wall 86 shown in FIG. 7 is a heavily mounted pivot point member 92, to be shown and discussed in greater detail in subsequent figures of the drawings. At the outer edges of the bed 84 are hold-down assemblies 94 and 96, located at the outer edges of the slab 84, with one being employed when a series of beams is being poured on one side of the central wall 86, and the other being employed when a series of beams is being poured or produced on the other side of the wall member 86.

Incidentally, in FIGS. 5, 6 and 7, the underlying casting slab 98 mentioned above as being in the nature of a "sidewalk" appears. This forms a convenient base for the sections of the bed which are employed in the implementation of the invention.

While the dimensions are not critical, typical dimensions which may be employed for the system as shown in FIGS. 4 through 7 would be a bed height of approximately 41 or 42 inches, a bed width from one edge to the other of about 7½ feet, a thickness of the base slab 84 of approximately 8 or 9 inches, and a thickness of the central wall 86 of about 11 or 12 inches. The height of each of the two walls 78 and 80 may be about 14 inches in extent above the base slab 84. Incidentally, the central wall 86 and the two outer walls 78 and 80 are firmly locked into the base slab 84 by suitable mild steel reinforcing rods.

Figure 8:
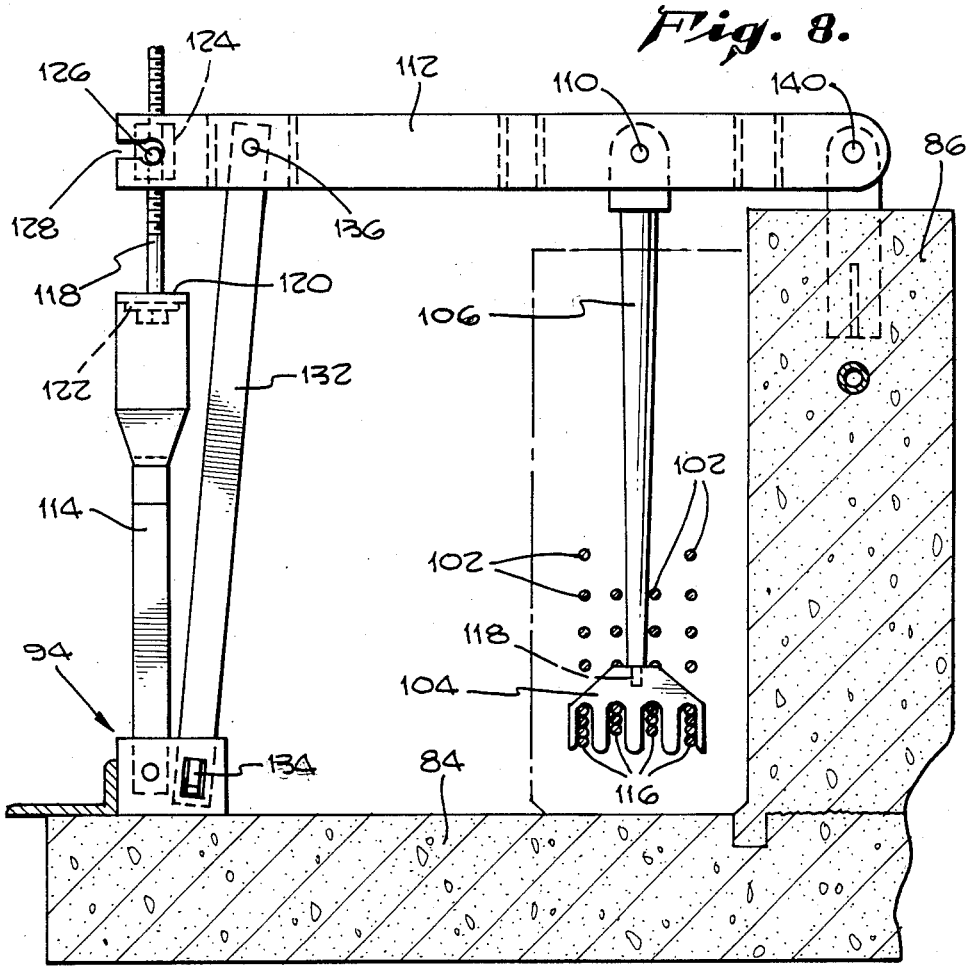
FIG. 8 is a side view of a lever-type harping mechanism employing a harping fork, and illustrating certain aspects of the present invention.

FIG. 8 is particularly of interest showing the arrangements for harping the steel cables or strands, which have previously been tensioned by the application of strong pressure using a hydraulic jack 87, at the plate 88, as shown in FIG. 6 of the drawings. The initial position of the steel cables or strands which are under tension, is indicated by the circles 102 which appear in FIG. 8. The fork member 104 is lowered into position to rest on the upper cable members 102, and the depressor rod 106 engages a recess 108 in the upper surface of the fork 104. The depressor rod 106 is pivotally mounted at point 110 to the harping lever 112. The harping lever 112 is coupled to the hold-down assembly 94 by the depressor arm 114. In order to tighten down the lever 112 and depress the steel strands 116, a heavy ¾ inch threaded bolt 118 is provided. This is coupled through a hole 120 and a bearing washer 122 to the upper end of the depressor arm 114. A heavy swivel nut 124 is mounted on pins 126 through a slot 128 in the outer end of the harping lever 112 and the bolt 118 is rotated to bring the lever arm 112 down. This may be accomplished using a pneumatic wrench of the type employed to take on and remove tire lugs. When the depressor rod 106 has been depressed to the position as shown in FIG. 8, so that the steel strands 116 are shifted down to the indicated locations, then the anchor strap 132 is secured in position by the wedge 134, to the hold-down assembly 94.

Incidentally, it may be noted that the anchor strap 132 is pivotally secured to the harping lever 112 at pivot point 136.

Figure 9:
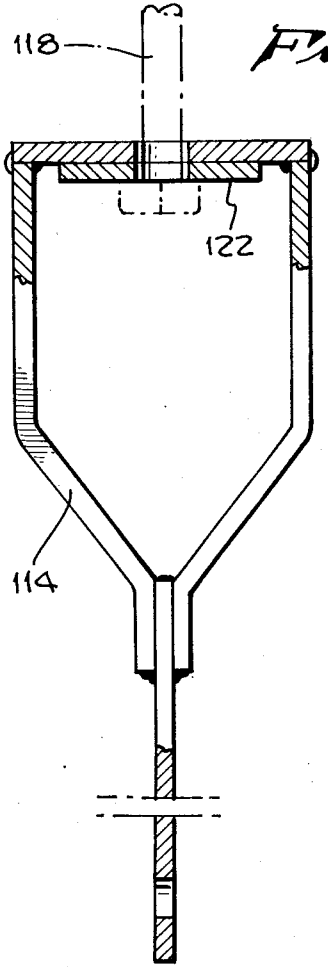
FIG. 9 is a side view of the depressor arm shown in FIG. 8.

FIG. 9 is included for purposes of completeness to show a side view of the depressor arm 114. Also shown in FIG. 9 is the bolt 118 and the washer 122 mentioned above in connection with FIG. 8, and the substantial open space toward the upper end of the depressor arm for receiving the pneumatic bolt actuator.

Figure 10:
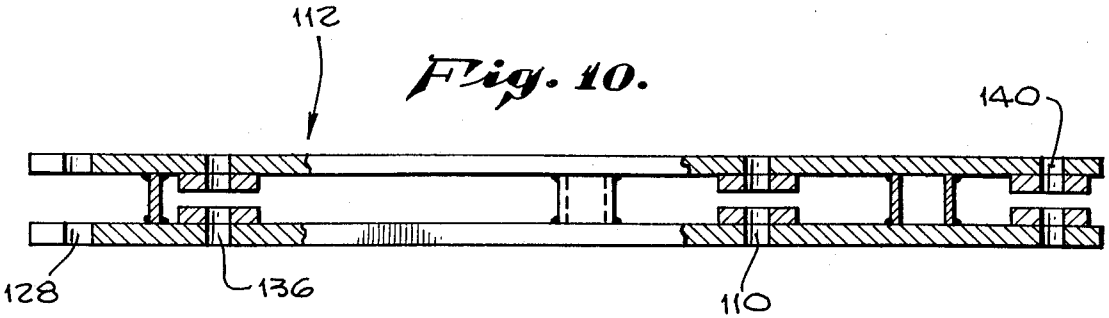
FIG. 10 is a top view of the harping lever aarm shown in FIG. 8.

FIG. 10 is a top view of the harping lever 112 showing the pivot point 110 where the lever is coupled to the depressor rod 106, and the pivot point 136 where the harping lever 112 is connected to the anchor strap 132. Also shown in FIG. 10 is the pivot point 138 where the harping lever 112 is secured to the pivot pins 126; and the pivot point 140 where the harping lever 112 is secured to the harping pivot support member 92 (see FIG. 7).

Figure 11:
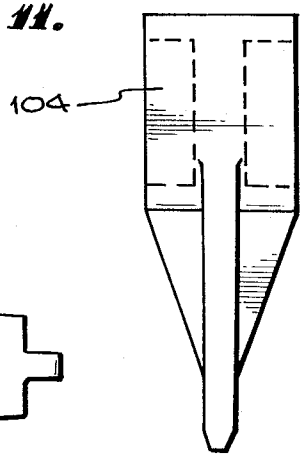
FIGS. 11 and 12 are side and top views, respectively, of the harping fork which appears in FIGS. 8 of the drawings.
Figure 12:
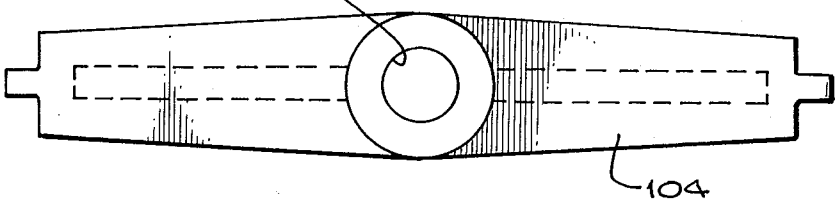

FIGS. 11 and 12 are side and top views, respectively, of the harping fork 104 shown in engagement with the steel strands 116, in FIG. 8. These figures are merely shown for purposes of completeness, and show nothing surprising. The recess 108 into which the depressor rod 106 fits, is visible in FIG. 12, directly, and is shown in dashed lines in FIG. 11. The harping fork 104 is, of course, left in the concrete beam after it is formed; however, the pin 106 is removed a day or two after the initial pouring of the concrete beam.

Figure 13:
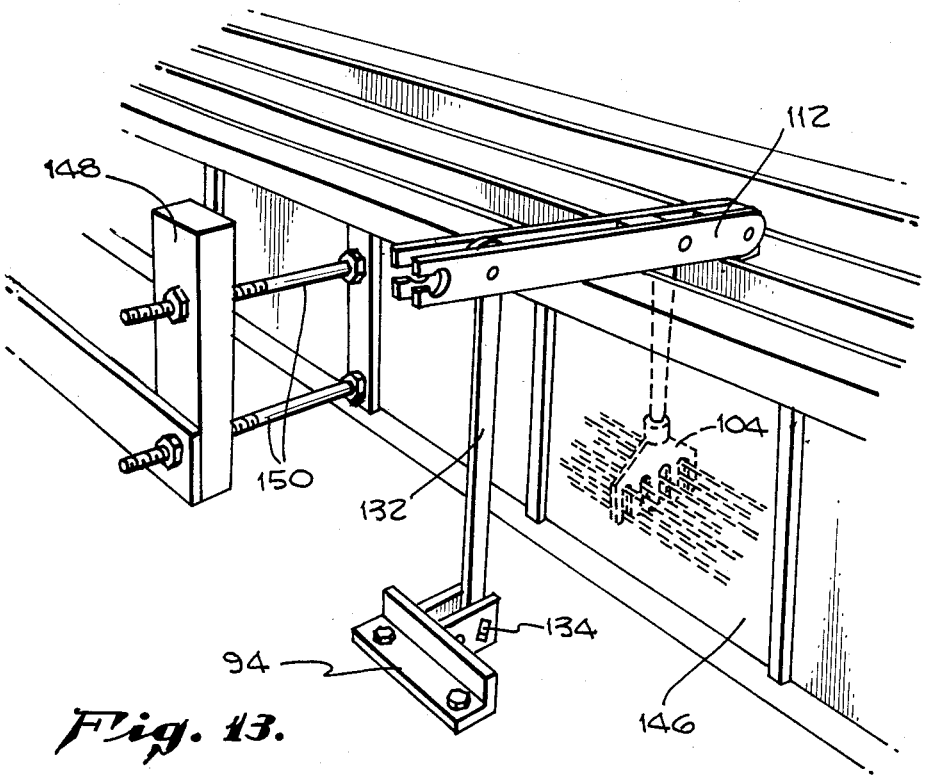
FIG. 13 is a perspective view of a harping lever locked in place, and one of the side posts, for holding the concrete form in position.

FIG. 13 is of interest in showing the harping lever 112 and the anchor strap 132, after the depressor arm assembly 114 has been removed, and has been taken to another harping point, for the purpose of depressing the steel tensioning cables at the center of the form for another beam which is to be poured.

In FIG. 13, the supporting arrangements for the form 146 which determines the thickness of the beam to be poured, are shown. More specifically, the supporting arrangements include the post 148, and the outwardly extending bolts 150 which position the supporting frame 146 at the desired distance from the center wall of the concrete assembly. A series of additional posts spaced apart by approximately 8 feet, are located up and down the entire length of the assembly.

Figure 14:
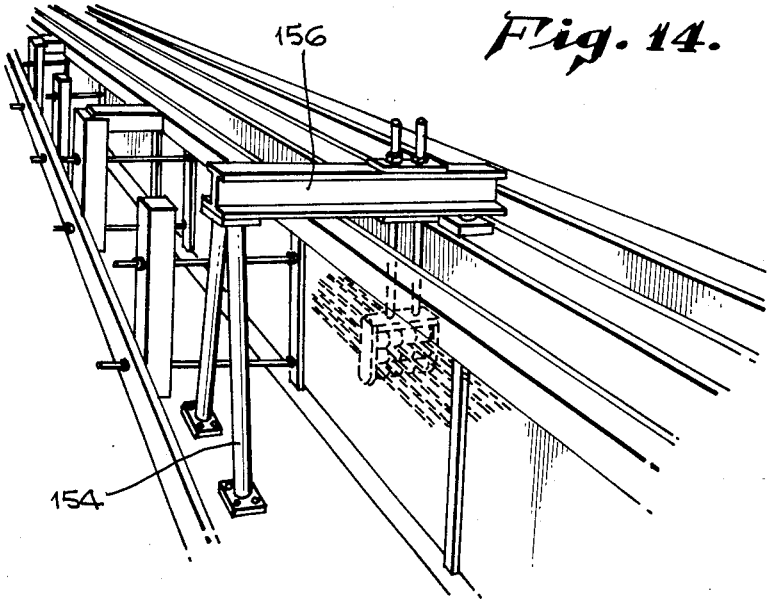
FIG. 14 is a perspective view of the mounting arrangements for a roller assembly holding the stressing cables at the proper elevation between the locations where the concrete beams are to be formed.

FIG. 14 is of interest in showing the assembly which is located between adjacent beams, where one beam ends, and the next beam starts. More specifically, the A-frame 154 supports the girder assembly 156, which in turn supports two heavy screws 158 to which the roller assembly 160 is mounted. The roller assembly 160 is a conventional structure which is employed to permit the steel tensioning cables to be held in their proper vertical and lateral orientation between beams, despite being depressed at the center of the beams, and having substantial pulls put upon them. The roller assemblies 160 are standard items and may be purchased, for example, from Dayton Superior Company, a well known manufacturer of this type of roller assembly.

Reference is also made to U.S. Pat. No. 4,149,306, granted Apr. 17, 1979 relating to "Portable Tensioning System For Producing Pre-Stressed Concrete Beams". In this patent, a portable bed for forming two concrete beams is disclosed, with the system having a number of sections which are E-shaped in cross section. The individual sections are secured together by longitudinally extending openings, and these are secured together by cables extending through the openings, to secure the portable sections together after the unit has been transported to a new location. The system of U.S. Pat. No. 4,149,306 also includes arrangements for pre-stressing longitudinally extending steel strands or cables through the entire length of the bed which would include arrangements for making several beams. Significant differences in the present system as compated with the portable system shown in U.S. Pat. No. 4,149,306 include, of course, the harping of the strands, the use of an inverted T-shaped cross section for the beds, instead of an E-shaped cross section, and the specialized arrangements for accomplishing the harping using the pivoted harping lever and the special harping fork.

Concerning some other aspects of the system, the hydraulic jack 89 shown in FIG. 1 for tensioning the cables is conventional, and is available as a purchase item from Dayton Superior Corporation, mentioned above. In practice the steel cables or strands are ½ inch in diameter, and are made of high strength steel having a yield point at about 270,000 psi. The mild steel reinforcing rod, by way of comparison, normally has a yield point at about 60,000 psi. In practice, stressing chucks are employed at the face of the steel plate 88, and, after applying about 30,000 pounds force to each strand, as the hydraulic jack is released, the stressing chucks grip the cable or strand and retain most of the force.

As a matter of additional interest, the cycle of operation of the system of the present invention is substantially as follows:

1. Wednesday 7 A.M. The beams which were poured on Monday at 2 P.M. are cut free from the tensioning cables and removed from the moulds.
2. Wednesday 8 A.M. Stockpiling completed beams.
3. Wednesday 8 A.M. Clean-Out Forms, apply release oil to the forms.
4. Wednesday 10 A.M. Crane puts Mild Steel Cages into beam form.
5. Wednesday 11 A.M. The steel tensioning cables are pulled through.
6. Wednesday 1 P.M. After Lunch. Stress steel strands.
7. Wednesday 2 P.M. Pour concrete in beam forms.
8. Thursday 7 A.M. Start Repeat Cycle on the other side of the portable bed relative to the beams poured on Tuesday afternoon.

As can be seen from the foregoig, each day brings a new set of beams, with about a 40 hour set-up time before the beams are set up enough to move and stack them.

In reviewing a typical case where the harped beam is compared with a conventional linearly stressed beam, the following points may be noted:

1. A linear stressed beam requires wrapping of the strands near the ends of the beam to avoid interlocking with the concrete, while no such wrapping is required for harped beams. Accordingly, the extra processing time for harping is comparable to that previously required for wrapping with linearly stressed beams.
2. Considering a sixty foot beam, 31 inches high, and comparing a harped beam with a linearly stressed beam, the following savings are achieved:
   (a) Width is reduced from 16 inches to 12 inches, saving 25% in concrete costs.
   (b) The number of steel strands is reduced to 14 from 16.
   (c) The amount of mild steel required is reduced by forty percent.
   (d) This is an overall reduction in materials of more than 20%.
3. With a much lighter weight structure, the building foundation requirements are reduced.
4. The thinner, lighter concrete beams make for a more aesthetically pleasing construction.
5. The economies using the local portable beds for the on-site fabrication of harped beams, are substantial, and are believed to be in the order of ten to twenty percent or more, as compared with either using linear on-site prestressed beams, or having harped prestressed beams brought in from a fixed central plant.

In conclusion, the foregoing detailed description and the accompanying drawings illustrate the preferred embodiment of the invention. However, various alternatives and modifications may be employed without departing from the spirit and scope of the invention. Thus, by way of example and not of limitation, the harping arrangements could pull a lesser number than all of the strands down, in successive pulls; the harped strands could be hooked or liked onto a removable sliding transverse rod in the bed; and the successive sections of the portable bed may be aligned and secured together by other arrangements than longitudinally extending cables. Accordingly, the present invention is not limited to that precisely as shown in the drawings and as described hereinabove.

What is claimed is:

1. A portable system for making precast, harped reinforced concrete beams comprising:

a set of inverted T-shaped sections of concrete, most of said sections being more than 20 feet long, said sections having aligned, spaced holes extending from end to end of each section;

means including tensioned cables passing freely through said aligned spaced holes for holding said T-shaped sections together and aligned with one another to form a portable bed;

means for providing beam forms on either side of the center of said T-shaped sections;

means for supporting and aligning a series of steel strands to pass through the lower half of each beam to be cast with the strands extending substantially from one end of the portable bed to the other, and said supporting means including means for providing steel strand roller supports along the length of the beam forms, between the intended ends of successive beams;

means for depressing and harping said strands substantially at the center of each intended beam; and said depressing means including a fixed pivot member mounted on the central wall of one of said T-shaped sections, a lever pivotally mounted to alternatively extend on either side of said central wall, means mechanically coupled to an intermediate point along said lever for engaging said steel strands, and means for engaging the outer end of said lever and pulling it down toward the exposed outer edge of one side of said T-shaped concrete section to substantially depress said steel strands and harp them;

whereby light weight, harped, pre-stressed concrete beams may be formed at the job site.

2. A portable system for making precast, harped reinforced concrete beams as defined in claim 1 wherein said depressing and harping means includes a fork having at least four downwardly extending tines, and at least three recesses between said tines for engaging at least three sets of said strands and holding them in the harped location as the concrete beams are poured and set up.

3. A portable system for making precast, harped reinforced concrete beams as defined in claim 1 wherein said means for engaging the outer end of said lever includes a depressor arm, and means including an elongated powerful threaded member intercoupling said depressor arm and said lever for drawing said arm and lever together as the threaded member is rotated.

4. A portable system for making precast, harped reinforced concrete as defined in claim 3 further including a pneumatic bolt actuating tool for rotating said threaded member.

5. A portable system for making precast, harped reinforced concrete beams as defined in claim 1 wherein each section of said portable bed is less than 80 feet long.

6. A portable system for making precast, harped reinforced concrete beams as defined in claim 1 wherein the total length of said portable bed is more than 200 feet, whereby a plurality of beams may be cast at a time.

7. A portable system for making precast, harped reinforced concrete beams as defined in claim 1 wherein a lever as defined in claim 1 is pivotally mounted near the center of each form for a concrete beam, and wherein a single common means for engaging the outer ends of said levers and pulling them down is provided.

8. A portable system for making precast, harped reinforced concrete beams as defined in claim 7 including means for rapidly coupling and decoupling said common means with each said lever; and further including anchor means for holding said lever down following pull-down by said common means.

9. A portable system for making precast, harped reinforced concrete beams as defined in claim 1 wherein special end sections are provided, each of said end sections having two outer walls extending along the edges of said sections, each wall being about one-half or less of the height of the central wall of said sections; and an apertured heavy metal plate engaging the outer end of the three walls of at least one of said end sections, to receive, hold, and align the stressed steel strands.

10. A portable system for making precast, harped reinforced concrete beams comprising:

a set of inverted T-shaped sections of concrete, most of said sections being more than 20 but less than 80 feet long;

means for holding said T-shaped sections together and aligned with one another to form an elongated portable bed including at least three of said sections;

means for providing beam forms on either side of the center of said T-shaped sections;

means for supporting and aligning a series of steel strands to pass through the lower half of each beam to be cast with the strands extending substantially from one end of the assembled T-shaped sections to the other, and said supporting means including means for providing steel strand roller supports along the length of the beam forms, between the intended ends of successive beams; and means for depressing said strands substantially at the center of each intended beam;

said depressing means including a fixed pivot point mounted on the central wall of one of said T-shaped sections, a lever pivotally mounted to alternatively extend on either side of said central wall, means secured to an intermediate point along said lever and including a fork for engaging said steel strands, and means for engaging the outer end of said lever and pulling it down toward the exposed outer edge of one side of said T-shaped concrete section to substantially depress said steel strands and harp them;

whereby light weight, harped, pre-stressed concrete beams may be formed at the job site.

11. A portable system for making precast, harped reinforced concrete beams as defined in claim 10 wherein said depressing and harping means includes a fork having at least four downwardly extending tines, and at least three recesses between said tines for engaging at least three sets of said strands and holding them in the harped location as the concrete beams are poured and set up.

12. A portable system for making precast, harped reinforced concrete beams as defined in claim 10 wherein said means for engaging the outer end of said lever includes a depressor arm, and means including an elongated powerful threaded member intercoupling said depressor arm and said lever for drawing said arm and lever together as the threaded member is rotated.

13. A portable system for making precast, harped reinforced concrete as defined in claim 12 further including a pneumatic bolt actuating tool for rotating said threaded member.

14. A portable system for making precast, harped reinforced concrete beams as defined in claim 10 wherein each section of said portable bed is less than 80 feet long.

15. A portable system for making precast, harped reinforced concrete beams as defined in claim 10 wherein the total length of said portable bed is more than 200 feet, whereby a plurality of beams may be cast at a time.

16. A portable system for making precast, harped reinforced concrete beams as defined in claim 10 wherein a lever as defined in claim 1 is pivotally mounted near the center of each form for a concrete beam, and wherein a single common means for engaging the outer ends of said levers and pulling them down is provided 17. A portable system for making precast, harped reinforced concrete beams as defined in claim 16 including means for rapidly coupling and decoupling said common means with each said lever; and further including anchor means for holding said lever down following pull-down by said common means.

18. A portable system for making precast, harped reinforced concrete beams as defined in claim 10 wherein special end sections are provided, each of said end sections having two outer walls extending along the edges of said sections, each wall being about one-half or less of the height of the central wall of said sections; and an apertured heavy metal plate engaging the outer end of the three walls of at least one of said end sections, to receive, hold, and align the stressed steel strands.

19. A system for harping steel strands extending longitudinally through a form for pouring a concrete beam, comprising:

a form in which the beam is cast;

a harping lever;

means for pivotally mounting said harping lever on one side of said form;

a harping fork having at least four outwardly extending tines, with recesses between said tines for engaging said steel strands;

a depressor rod coupling said harping fork to said lever near said pivotal mounting means; and means for applying force to the outer end of said lever more than twice as far from said pivotal mounting means than said depressor rod, to depress and harp said steel strands within said beam.

20. A system as defined in claim 19 wherein said force applying means includes a depressor arm, and means including an elongated powerful threaded member intercoupling said depressor arm and said lever for drawing said arm and lever together as the threaded member is rotated.

21. A system as defined in claim 19 further comprising anchor means for holding said lever down after it has been depressed and said steel strands have been harped.

* * * * *